United States Patent [19]

Discepolo

[11] Patent Number: 5,001,978

[45] Date of Patent: Mar. 26, 1991

[54] COMPACTOR FOR RECYCLING

[76] Inventor: George W. A. Discepolo, 5278 Cindy La., Burlington, Ontario L7L 3Y2, Canada

[21] Appl. No.: 500,342

[22] Filed: Mar. 28, 1990

[51] Int. Cl.[5] ..... B30B 15/30

[52] U.S. Cl. ..... 100/215; 100/225; 100/229 A; 100/252

[58] Field of Search ..... 220/909; 100/215, 221, 100/225, 229 A, 237, 252, 269 R

[56] References Cited

U.S. PATENT DOCUMENTS

| | | | |
|---|---|---|---|
| 256,904 | 4/1882 | Laass | 100/225 |
| 992,006 | 5/1911 | Kubersky et al. | 220/909 |
| 3,438,321 | 4/1969 | Gladwin | 100/221 |
| 3,575,103 | 4/1971 | Charles | 100/229 A |
| 3,734,006 | 5/1973 | Hennells | 100/215 |
| 4,436,026 | 3/1984 | Imamura et al. | 100/215 |
| 4,905,853 | 3/1990 | Strawder | 220/909 |

FOREIGN PATENT DOCUMENTS

| | | | |
|---|---|---|---|
| 2625944 | 2/1989 | France | 100/215 |

*Primary Examiner*—William A. Cuchlinski, Jr.
*Assistant Examiner*—G. Bradley Bennett
*Attorney, Agent, or Firm*—Rogers, Bereskin & Parr

[57] ABSTRACT

A compactor for use in compacting at least two separate classes of material comprises a charging box, a storage container and a packer ram. The charging box is internally, longitudinally divided into at least first and second charging chambers, each charging chamber having a charging opening and a discharging opening. The storage container is internally divided into at least first and second storage chambers and each chamber has a material receiving opening in communication with a respective discharging opening of the charging box. The storage container is releasably fixed relative to the charging box. The packer ram has at least first and second compacting faces, in a first configuration each face forming a portion of a wall of a respective charging chamber opposite the discharging opening, the faces being mounted to a common actuator and movable from the first configuration across the charging chambers to simultaneously push material from the charging chambers through the discharging openings and into the respective storage chambers. Different classes or grades of material, such as recyclable and non-recyclable garbage, may thus be compacted and stored separately using a single compactor apparatus.

17 Claims, 2 Drawing Sheets

COMPACTOR FOR RECYCLING

FIELD OF THE INVENTION

This invention relates to compactors, and in particular to garbage compactors.

BACKGROUND OF THE INVENTION

Existing garbage compactors are typically formed as a single metal container connected to a compacting unit. The compacting unit includes a charging box in communication with the container, a ram being provided for pushing garbage which has collected in the charging box into the container. In many malls, offices and factories, compactors are provided for receiving a particular form of waste, for example, corrugated cardboard, which is collected for recycling. At some sites only a single compactor will be provided at a site, and other forms of garbage may be thrown into the charging box with the corrugated cardboard. This may result in the loss of the entire load of the filled container for recycling, and such contamination of a load is often not discovered until the container load of material has been taken to a recycling depot and unloaded. If the material has been spoiled, it is necessary to reload the container and transport the material to another site for, for example, incineration or disposal in a landfill site. In addition to the loss of the recyclable material, there is also a considerable expense in transporting the material and there will likely be a charge for disposing of the material.

SUMMARY OF THE INVENTION

According to the present invention there is provided a compactor for use in compacting at least two separate classes of material comprising a charging box and a packer ram in combination with a storage container. The charging box is internally, longitudinally divided into at least first and second charging chambers, each charging chamber having a charging opening and a discharging opening. The storage container is releasably fixed relative to the charging box and is internally divided into at least first and second storage chambers. Each storage chamber has a material receiving opening in communication with a respective discharging opening of the charging box. The packer ram has at least first and second compacting faces and in a first configuration each face forms a portion of a wall of a respective charging chamber opposite the discharging opening. The compacting faces are mounted to a common actuator and are movable from the first configuration across the respective charging chambers to simultaneously push material from the charging chambers through the discharging openings and into the respective storage chambers.

BRIEF DESCRIPTION OF DRAWINGS

This and other aspects of the present invention will now be described, by way of example, with reference to the accompanying drawings, in which.

DETAILED DESCRIPTION OF THE DRAWINGS

Figure 2:
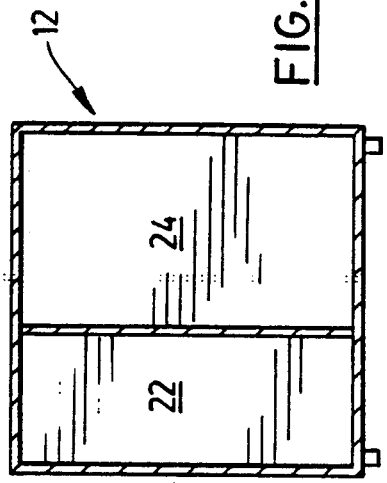
FIG. 2 is a sectional view of the storage container taken on line 2–2 of FIG. 1.
Figure 1:
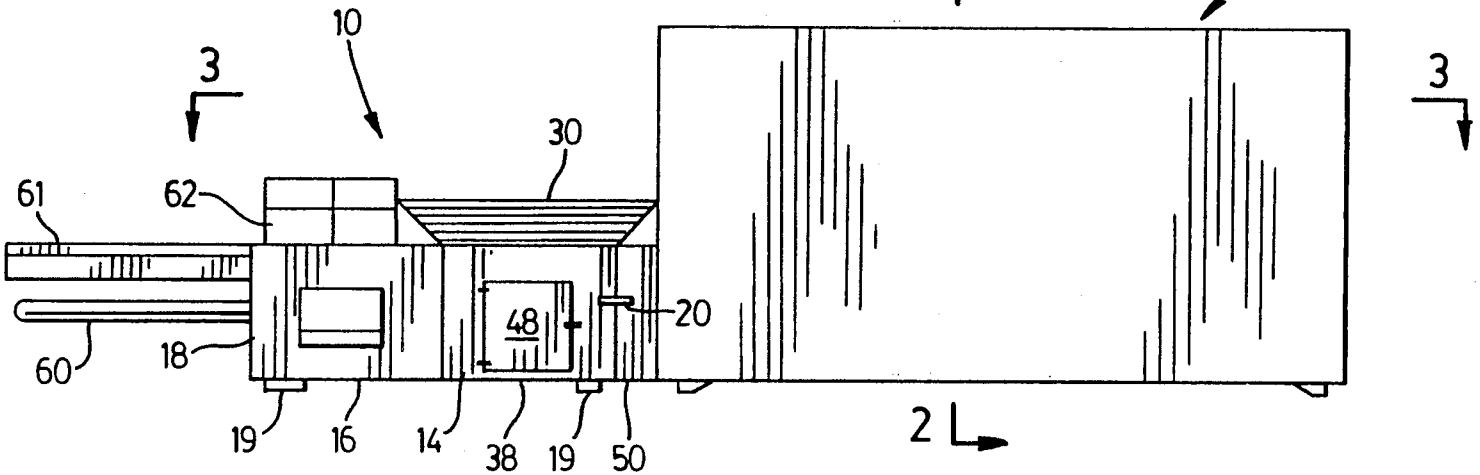
FIG. 1 is a side view of a compactor in accordance with a preferred embodiment of the present invention shown in combination with a storage container.

Reference is first made to FIG. 1 of the drawings, which illustrates a compactor unit 10 releasably coupled to a storage container 12. The compactor unit 10 includes a charging area 14, a ram assembly housing 16 and a hydraulics compartment 18. The compactor unit 10 rests on the ground, on feet 19, and is attached to the storage container 12 at an extension of the container 20 which includes openings for receiving material from the charging area 14. The storage container 12 is in the form of a large rectangular steel box and, as can be seen in FIG. 2 of the drawings, is longitudinally divided into first and second storage chambers 22, 24, in this example having widths of 5′ and 3′, respectively.

The compactor unit 10 and the storage container 12 are intended for use in collecting and storing at least two different classes of material. Hence the division of the storage container 12 into the first and second storage chambers 22, 24. If reference is now made to FIG. 3 of the drawings, it will be noted that the charging area 14, which is open-topped, is similarly internally, longitudinally divided into first and second charging chambers 26, 28. As will be described in more detail below, the divided charging area and storage container, in conjunction with a specially adapted ram, allow two separate classes of material to be collected and stored using a single compactor unit and a single storage container.

Figure 3:
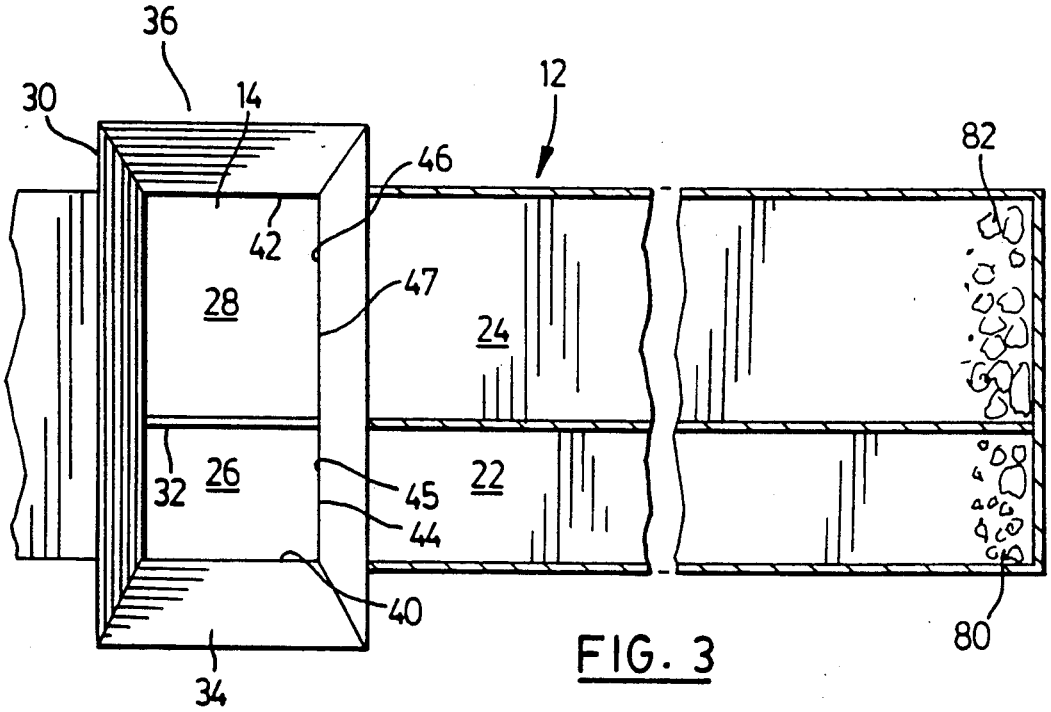
FIG. 3 is a sectional view on line 3–3 of FIG. 1.

Referring now in particular to FIGS. 1 and 3, it can be seen that a hopper 30 is provided above the charging area 14. The hopper 30 extends upwardly and outwardly on three sides of the charging area and restricts access to the charging chambers, for safety reasons, and also provides a larger receiving area for the material to be placed in the charging chambers. An internal divider 32 extends from the charging unit 14 into the hopper 30, thus dividing the hopper 30 into two separate catch areas 34, 36, each associated with a respective charging chamber 26, 28. If desired, bin or conveyor loading may be provided on both sides of the hopper 30.

The charging area 14 is generally rectangular in form having a base 38 and upright sidewalls 40, 42. The side of the charging unit 14 adjacent the storage container 12 is open to provide discharging openings 44, 46 from the respective charging chambers 26, 28 into the storage container, leading directly to respective material receiving openings 45, 47 of the container 12. Each of the sidewalls 40, 42 includes a clean-out door 48 (only one shown) which may be used to, for example, remove undesirable material from the respective storage chamber or to clear blockages or jams which occur in the chambers.

To secure the compactor unit 10 to the storage container 12, the sidewalls 40, 42 are provided with container coupling latches 50 (only one shown) which engage the sides of extension 20 provided on the end of the storage container 12.

Figure 4:
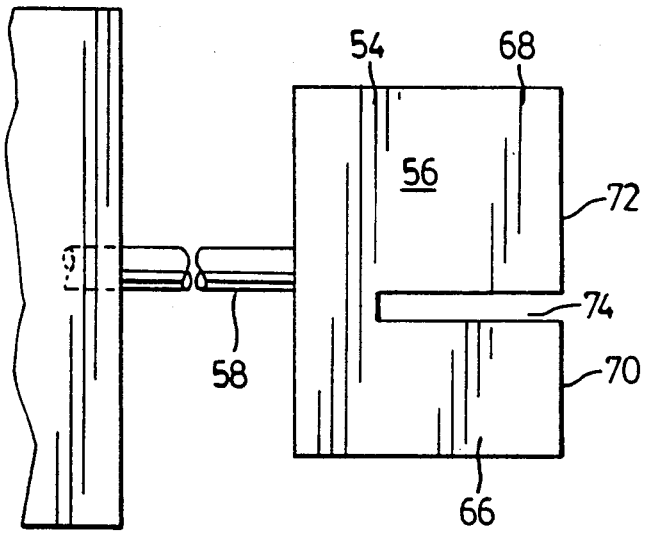
FIG. 4 is a plan view of a packer ram for use with the compactor of FIG. 1.

The remaining wall of the charging area 14 is formed by the leading face of a ram 54 (FIG. 4), normally accommodated within the ram housing 16, and details of which are shown in FIG. 4 of the drawings. The ram 54 comprises a ram head 56 mounted on a piston 58 which extends from a sleeve 60 (FIG. 1) located below an operator platform 61. Movement of the piston 58 in the sleeve, and thus the movement of the ram head 56 is achieved by use of hydraulics provided in the hydraulics compartment 18 controlled via a control box 62 provided on one side of the compartment 18. To permit the ram head 56 to be moved through the charging area 14, the head 56 is longitudinally divided to form first and second ram portions 66, 68 each having a respective compacting face 70, 72. An upright slot 74 extends through the ram head in alignment with the internal divider 32 such that the ram portions 66, 68 may be advanced from the charging position to a position where the compacting faces 70, 72 are located in the respective discharging openings 44, 46. Material placed in the charging chambers 26, 28 is thus discharged from the charging unit 14 through the material receiving openings 45, 47 into the respective storage chambers 22, 24. The ram head 56 is then withdrawn to the charging position to permit more material to be placed in the charging chambers 26, 28 via the hopper 30.

Once one of the storage chambers 22, 24 has been filled with material, the container coupling latches 50 are released and the storage container 12 pulled from the compactor unit and replaced by an empty container. Doors are provided for closing the material receiving openings 45, 47 and the storage container 12 is then, for example, mounted on a suitably adapted truck and transported to, for example, a recycling depot. The end of the storage container 12, which is normally remote from the compactor unit 10, is provided with unloading doors 80, 82, one for each storage chamber 22, 24. The doors 80, 82 may be opened separately such that, for example, the materials in the chambers 22, 24 may be separately tipped from the container.

The container 12 is preferably formed of ⅝" steel plates with tubular reinforcing at stress points. Wear-resistant special manganese steel floor and sidewall wear-bars may also be employed. Container capacity will typically range from 18 to 42 cubic yards, with wall height of 87" to 96" and a skid length of 18' to 24'.

The charging area 14 is preferably of dimensions 36"×60"×40" to provide a hopper capacity of 2½ cubic yards and may be provided with self adjusting wear plates to provide constant alignment of the ram regardless of reaction load forces.

The ram head preferably has dimensions of 59½" wide×30" high and a cycle time of 33 seconds.

A preferred hydralics system or pack has a reservoir capacity of 35 gallons and would deliver 7½ g.p.m. from a fixed displacement pump with a double action 5" diameter bore cylinder and a normal operating pressure of 1810 p.s.i..

Control of the hydraulics system and ram may be manual or alternatively could be by means of preprogrammed automatic control.

Although the charging area and container described above each have only two separate chambers, for collecting two different classes of material, further internal dividers may be provided to form a greater number of chambers, thus allowing the compactor and container to handle more than two classes of material. Also, the location of the divider may be changed to vary the size of the chambers, to suit expected proportions of materials.

Further, the internal dividers do not have to be arranged in upright configurations, and could equally be extended horizontally across the charging area and container. Clearly, this would require the provision of a different arrangement for loading the charging chamber.

I claim:

1. A compactor for use in compacting at least two separate classes of material in combination with a storage container for receiving material from the compactor, the compactor including:

a charging area internally, longitudinally divided into at least first and second charging chambers, each charging chamber having a charging opening and a discharging opening, and the storage container being internally divided into at least first and second storage chambers and each chamber having a material receiving opening in communication with a respective discharging opening of the charging box, the storage container being releasably fixed relative to the charging box, and the compactor further including a packer ram having at least first and second compacting faces, in a first configuration, each face forming a portion of a wall of a respective charging chamber opposite the discharging opening, the faces being mounted to a common actuator and movable from said first configuration across the respective charging chambers to simultaneously push material from the charging chambers through the discharging openings and into the respective storage chambers.

2. The compactor and storage container of claim 1, wherein the first and second compacting heads are formed on respective first and second rams, the rams being of corresponding cross section to the respective charging chambers.

3. The compactor and storage container of claim 2, wherein each storage chamber of the storage container is provided with an unloading door through which the respective chamber may be emptied.

4. The compactor and storage container of claim 3, wherein the charging area is open-topped.

5. The compactor and storage container of claim 4, wherein a loading hopper is provided at each charging opening of the charging area.

6. The compactor and storage container of claim 5, wherein each one of the charging area and the storage container is divided by an upright division.

7. The compactor and storage container of claim 6, wherein a plurality of upright divisions are provided in each of the charging area and the storage container.

8. The compactor and storage container of claim 6, wherein the packer ram is hydraulically activated.

9. The compactor and storage container of claim 6, wherein the packer ram includes a unitary packer head, a slot being formed in a leading edge portion of the packer head to define said first and second compacting faces, the slot being of a depth at least equal to the length of the charging area.

10. A compactor for use in compacting at least two separate classes of material and transferring material to a storage container associated with the compactor, the compactor including a charging area internally, longitudinally divided into at least first and second charging chambers, each charging chamber having a charging opening and a discharging opening, a packer ram having at least first and second compacting faces, and a first configuration, each face forming a portion of a wall of a respective charging chamber opposite the discharging opening, the faces being mounted to a common actuator and moveable from said first configuration across the respective charging chambers to simultaneously push material from the charging chambers through the discharging openings to an associated storage container.

11. The compactor of claim 10, wherein the first and second compacting heads are formed on respective first and second rams, the rams being of corresponding cross section to the respective charging chambers.

12. The compactor of claim 11, wherein the charging area is open topped.

13. The compactor of claim 12, wherein a loading hopper is provided at each charging opening of the charging area.

14. The compactor of claim 13, wherein the charging area is divided by an upright division.

15. The compactor of claim 14, wherein a plurality of upright divisions are provided in the charging area.

16. The compactor of claim 14, wherein the packer ram is hydraulically activated.

17. The compactor of claim 14, wherein the packer ram includes a unitary packer head, a slot being formed in a leading edge portion of the packer to define said first and second compacting faces, the slot being of a depth at least equal to the length of the charging area.

* * * * *